US005772498A

United States Patent [19]

Neubert et al.

[11] Patent Number: 5,772,498

[45] Date of Patent: Jun. 30, 1998

[54] ELECTRICAL HAND GRINDER

[75] Inventors: Werner Neubert, Stuttgart; Rudolf Fuchs, Neuhausen, both of Germany

[73] Assignee: Robert Bosch GmbH, Stuttgart, Germany

[21] Appl. No.: 799,243

[22] Filed: Feb. 14, 1997

[30] Foreign Application Priority Data

Mar. 8, 1996 [DE] Germany ..... 196 08 969.7

[51] Int. Cl.[6] ..... B24B 23/00

[52] U.S. Cl. ..... 451/357

[58] Field of Search ..... 451/356, 357, 451/364, 359; 200/332.2, 293.1, 61.85, 510; 310/68 A

[56] References Cited

U.S. PATENT DOCUMENTS

| | | | |
|---|---|---|---|
| 2,200,322 | 5/1940 | Arnesen | 200/293.1 |
| 3,570,816 | 3/1971 | Germond | 200/293.1 |
| 4,475,317 | 10/1984 | Dicke | 451/357 |
| 5,206,967 | 5/1993 | Fushiya et al. | 451/357 |
| 5,453,040 | 9/1995 | Schaal et al. | 451/357 |
| 5,496,207 | 3/1996 | Hornung et al. | 451/357 |
| 5,580,302 | 12/1996 | Howard et al. | 451/357 |
| 5,626,510 | 5/1997 | Berger et al. | 451/357 |

FOREIGN PATENT DOCUMENTS 0 610 801 A1 8/1994 European Pat. Off. .

*Primary Examiner*—Robert A. Rose
*Assistant Examiner*—George Nguyen
*Attorney, Agent, or Firm*—Michael J. Striker

[57] ABSTRACT

An electrical hand grinder has a machine housing having a housing axis and composed of two housing shells which are assembled with one another along a separating joint located in a plane of the housing axis, an electric motor having a driven shaft and received in the machine housing, an eccentric pin extending outwardly of the machine housing and driven by the driven shaft of the electric motor, a grinding disk arranged on the eccentric pin and having a lower side for receiving a grinding element, a ventilator wheel for cooling the electric motor, the ventilator wheel and the eccentric pin being formed as sheet metal stamped parts which are assembled with eccentrically oriented axes, one of the sheet metal stamped parts which forms the ventilator wheel being provided with a one-piece sleeve arranged on the driven shaft of the electric motor for joint rotation with the driven shaft.

15 Claims, 7 Drawing Sheets

ELECTRICAL HAND GRINDER

BACKGROUND OF THE INVENTION

The present invention relates generally to electrical hand grinders.

More particularly, it relates to an electrical hand grinder which is formed as a vibration grinder.

Electrical hand grinders formed as vibration grinders are known in the art. One of such electrical hand grinders is disclosed for example in the European patent document EP 0 610 801 A1. In this vibration grinder the grinding plate is triangular and fixed through vibration elements on a machine housing, so that because of rotatable eccentric pins it performs only a reciprocating grinding movement. The grinding plate is subdivided into a plate holder and a grinding plate which is releasably mounted on it. The grinding plate is supported rotatably on the eccentric cams and is secured with the vibration elements which are of one-piece with it against joint rotation. The vibration elements are received at their ends in the recesses in the machine housing. The grinding plates carries grinding means, for example a grinding paper disk, on its lower side which faces away from the plate holder. The above described electrical hand grinder can be further improved.

SUMMARY OF THE INVENTION

Accordingly, it is an object of present invention to provide an electrical hand grinder, which is a further improvement of the existing hand grinders.

In keeping with these objects and with others which will become apparent hereinafter, one feature of the present invention resides, briefly stated, in an electric hand grinder in which the ventilator wheel and the eccentric pin is composed of a sheet metal stamped part which is preferably produced with a joint metal punching tool, the sheet metal stamped parts are assembled with eccentrically oriented axes, and the sheet metal stamped part which forms the ventilator wheel is arranged with a one-piece sleeve formed on it, on a driven shaft of the electric motor for joint rotation with the driven shaft.

When the electric hand grinder is designed in accordance with the present invention, it has a construction with which a connection and reduction of components is obtained, which leads to a reduction of manufacturing costs. The ventilator wheel and the eccentric pin are produced only with one punching tool in a single working step, and by corresponding bending and separation and mechanical connection in a further working step a single part with two functions is formed. Tool and storage costs are reduced and the mounting costs are lowered because of simplification of the mounting. By combining of the ventilator and the eccentric pins also a lower construction of the hand grinder is obtained. Thereby providing a dust aspiration itself, in the same working step the ventilator wheel needed for the dust aspiration can be produced of one-piece with the eccentric pins from the same sheet metal stamped part.

A further cost reduction is provided when in accordance with a further embodiment of the invention with the electric motor formed as a commutator motor the brush holder is formed by a synthetic plastic supporting plate with formed brush shoes, on which a brass stamped part for the electrical current conduction is mounted. During assembly of the two-shell machine housing, the synthetic plastic supporting plate is received in corresponding grooves in each housing shell and is clamped in the machine housing without additional components.

In accordance with a further feature of present invention, the grinding plate is composed of two plate halves which are assembled along a separating joint extending in the plane of the housing separating joint, and one grinding plate half and the half of the vibration elements are formed of one-piece on one housing shell, while both housing shells and both plate halves are connected with one another by one-piece formed snapping elements along their separating joints. In this construction, the machine housing, the grinding plate, and the vibration elements form an assembly of synthetic plastic material constructed cells. The separately produced halves of the synthetic plastic assembly are simply placed on one another after insertion of the inner components and arrested with one another by pressure. The tool-less and mounting is time consuming and can be easily automated. At this mounting, by customers and thereby an inexperienced repair is no longer possible. The number of the locking points can be arbitrarily selected without more expenses by the formed snapping elements.

A further cost reduction is obtained when in accordance with a further feature of present invention, the quick clamping means for the grinding means are formed at least on the grinding plate half. The quick clamping means can be designed in different ways as disclosed in various embodiments of the invention.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
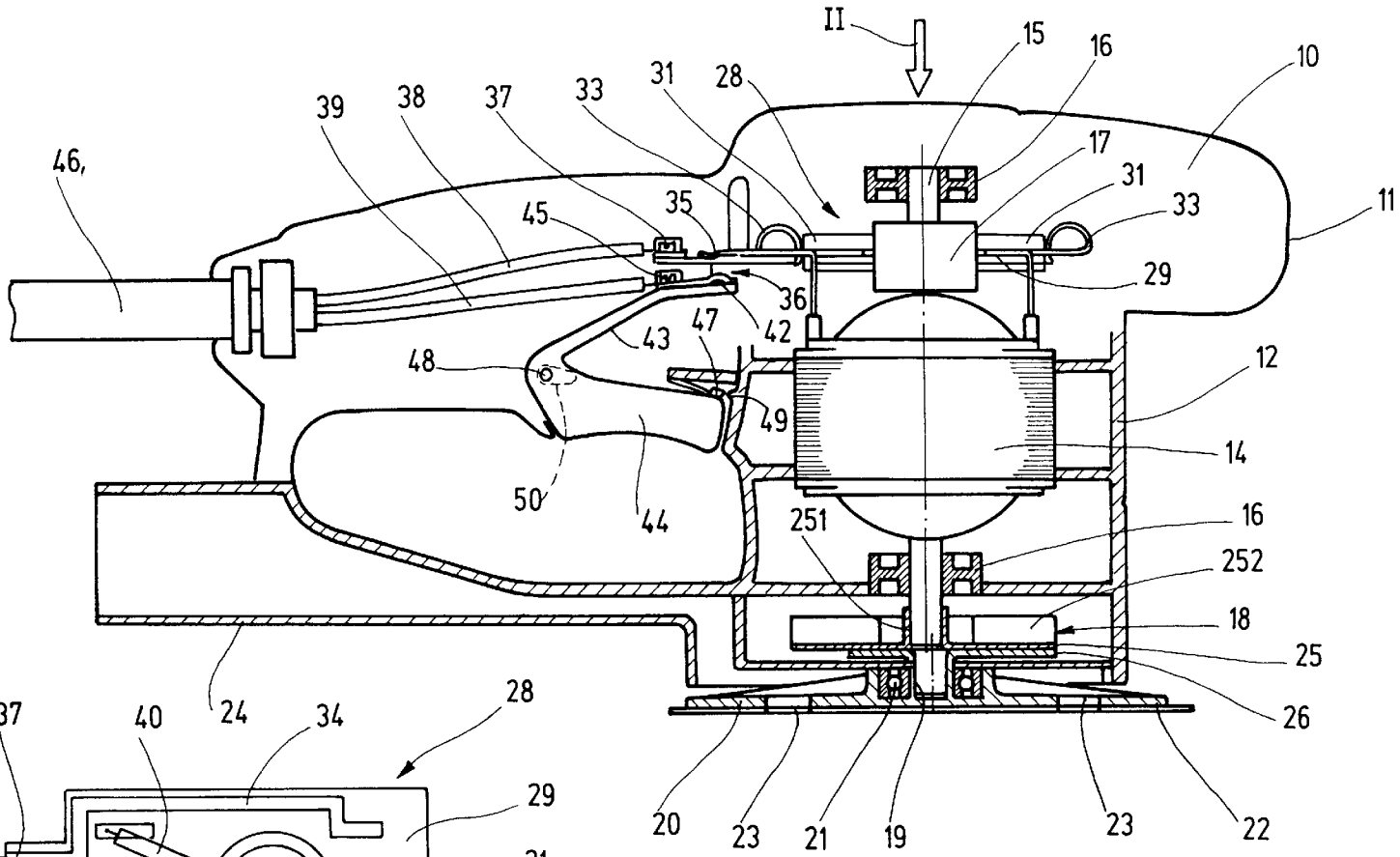
FIG. 1 is a view showing a longitudinal section of an eccentric grinder with aspiration of dust, partially schematically.
Figure 6:
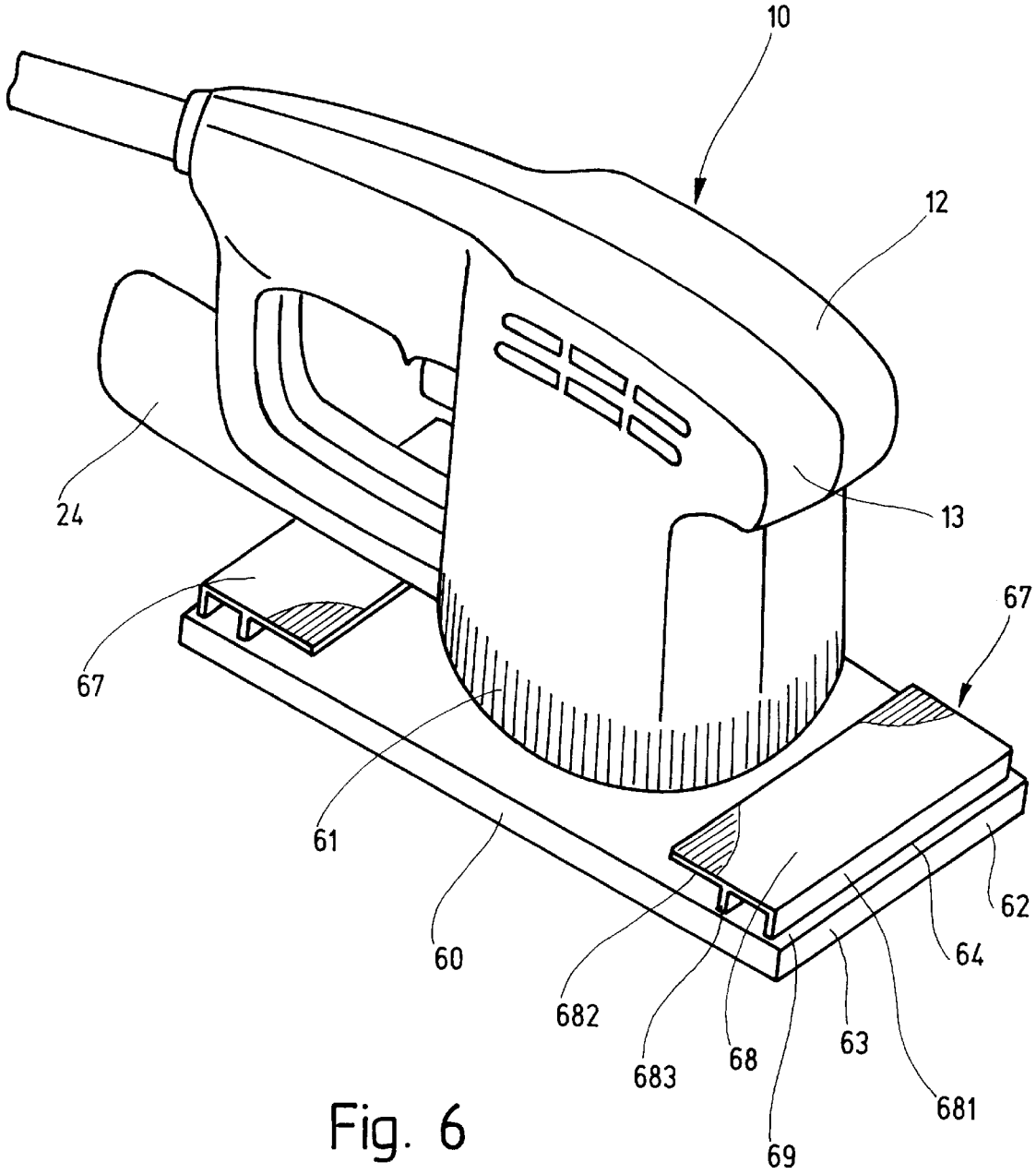
FIG. 6 is a perspective view of a vibration grinder of the present invention.

FIG. 1 shows an electrical hand grinder formed as an eccentric grinder. The grinder has a machine housing 10 composed of two housing shells 12 and 13 of synthetic plastic material which are assembled along a separating joint 11 as can be seen in FIG. 6. FIG. 1 shows only the left housing 12 of the machine housing 10. The separating joint 11 is located in one plane with a housing axis.

An electric motor 14 which is formed as a commutator motor is located in the machine housing 10. Its driven shaft 15 is rotatably received in two bearing plates formed on the housing shelves 12 and 13. A commutator 17 and a ventilator wheel 18 for cooling the motor are mounted on the driven shaft 15 for joint rotation with it. The driven shaft 15 engages non rotatably with an eccentric pin 19, which extends on the lower side of the machine housing 10. A circular grinding plate 20 is arranged on the projecting end of the eccentric pin. A ball bearing 21 is arranged between the eccentric pin 19. The grinding plate 20 at a lower side which faces away from the machine housing 10 carries a burdock coating connection of a grinding disk 22 composed of grained paper. For the dust aspiration the grinding plate 20 as well as the grinding disk 22 are provided with aspiration openings 23. The grinding dusk can be aspirated through the openings 23 via a dust passage 34 formed on the machine housing 10 and connected to an external impeller.

Figure 3:
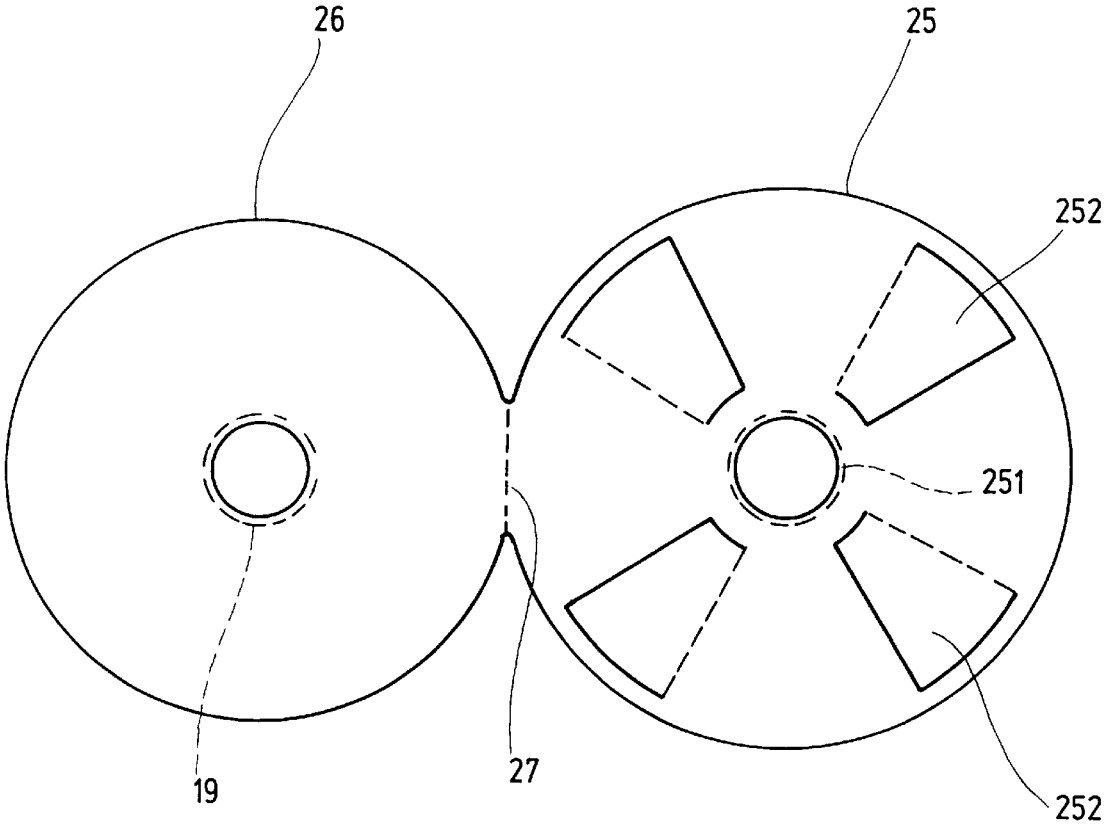
FIG. 3 is a plan view of a sheet metal stamped part for producing a ventilator wheel and eccentric pins of the eccentric grinder of FIG. 1.
Figure 4:
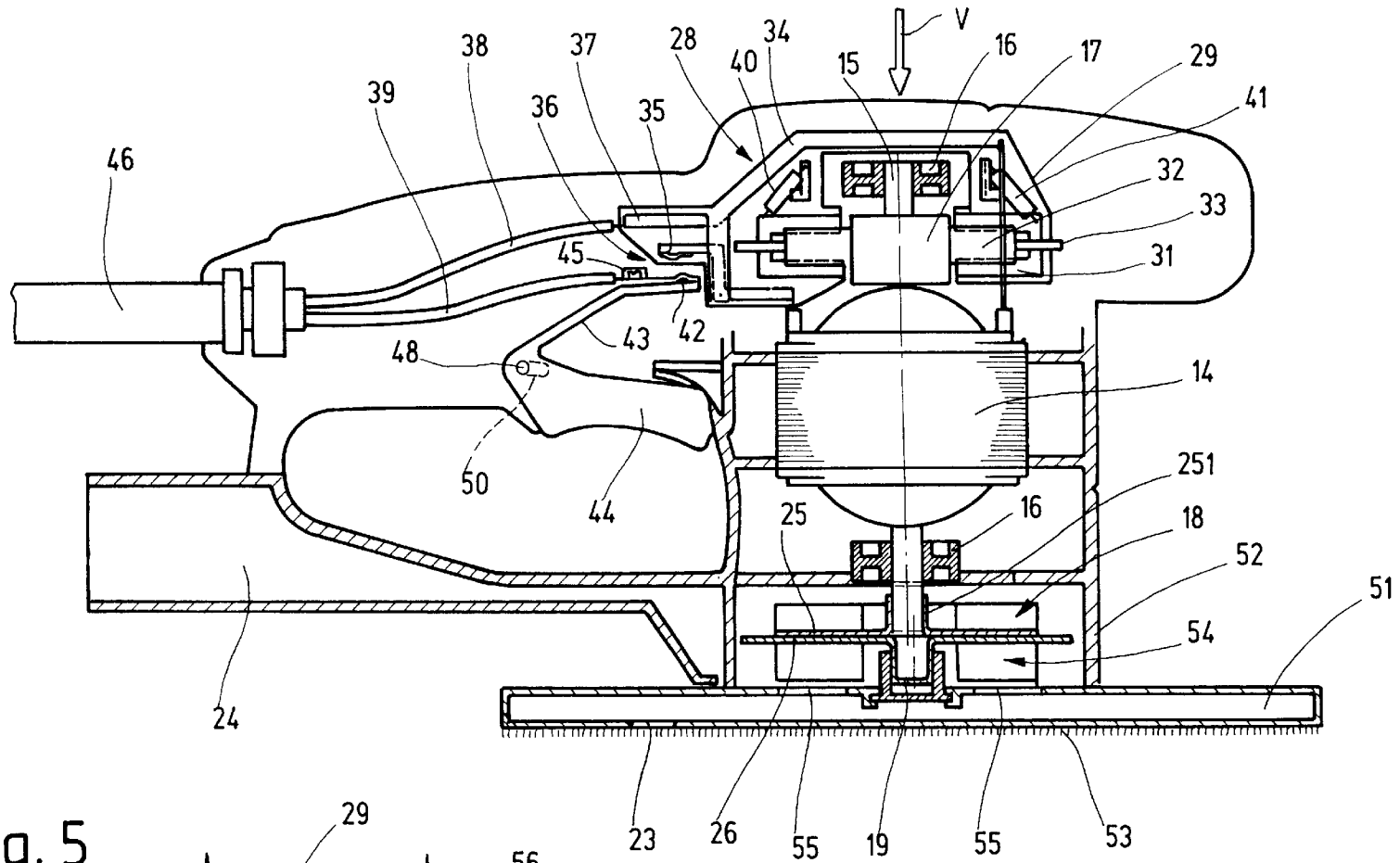
FIG. 4 is a view showing a longitudinal section of a vibration grinder with dust aspiration, partially schematically.

For reducing the mounting costs, the ventilator wheel 18 and the eccentric pin 19 are each composed of a sheet metal stamped part 25, 26 correspondingly. As shown in FIG. 3, both sheet metal stamped parts 25, 26 are produced with a joint sheet metal punching tool in a sheet metal stamped portion. A concentric sleeve 251 is formed on the sheet metal stamped part 25, while on the sheet metal stamped part 26 the eccentric pin 19 is pressed out in a sleeve-like manner. Additionally, ventilator vanes 252 are stamped in the sheet metal part 25 and bent around their base line perpendicularly from the sheet metal stamped part 25. The sheet metal stamped part 26 is folded around the bending line 27 on the rear side of the sheet metal stamped part 25 and fixedly connected with it. By bending the eccentric pin 19 has automatically the desired eccentricity relative to the sleeve 251. It is to be understood that it is also possible to separate both sheet metal stamped parts 25, 26 from one another, to provide the desired eccentricity of the eccentric pin 19 and the sleeve 251 relative to one another, and fixedly connect them with one another as shown in FIG. 4. The assembly including the ventilator wheel 18 for cooling of the motor and the eccentric pin 19 for driving the grinding plate as shown in FIG. 1 is fitted over the free end of the driven shaft 15 which projects over the lower bearing plate 16 and fixed on it.

Figure 2:
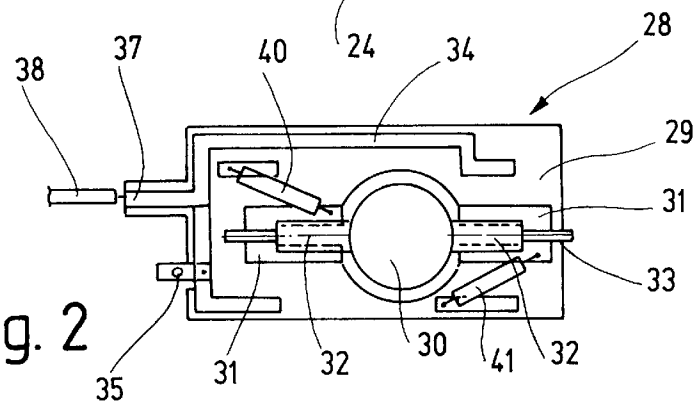
FIG. 2 is a plan view of a brush holder of the eccentric grinder of FIG. 1 as seen in direction of the arrow II of this FIG.

The electric motor 14 has a brush holder 28 which is composed here of a synthetic plastic supporting plate 29 shown on a plan view in FIG. 2. The synthetic plastic supporting plate 29 has a central circular opening 13 for the passage of the commutator 17 of the electric motor 14. Two brush shoes 31 are formed of one-piece on the synthetic plastic supporting plate 29 diametrically to the opening 30. A carbon brush 32 is inserted axially displaceably in each brush shoe 31 and pressed at an end side by a brush pressing strip 33 against the outer surface of the commutator. A brass stamped part 34 is mounted on the synthetic plastic supporting plate 29 for electrical current supply. A contact tongue 35 of an electrical switch 36 for switching on and switching off of the electric motor 14 projects on the brass stamped part 34, and a connecting screw 37 for mounting an electrical connecting conduit 38 is screwed in it.

The both carbon brushes 32 as well as a choke 40 and a capacitor 41 for spark suppression are connected with the brass stamped part 34. The second contact of the electrical switch 36 corresponding to the contact tongue 35 is formed as a contact plate 42 which is mounted on an end portion of a springy web 33. The springy web 33 is formed of one-piece with a push button 44 of synthetic plastic material for the manual switch actuation. The web 43 must be moved by further not shown spring means during switching on and switching off in particular in accelerated manner to its switching position so as to prevent light arks are burning of the contacts. A connection screw 45 for mounting the second connecting conduit 39 of an electrical connecting cable 46 inserted in the machine housing 10 is screwed in the contact plate 42. A further arresting projection 47 and a transversely projecting pin 48 are formed of one-piece with the synthetic plastic push button 44. The arresting projection 47 is arranged in correspondence with a notch 49 in the machine housing 10 for locking the push button 44 with the closed switch 36, and the pin 48 is arranged in correspondence with an elongated recess 50 formed in the machine housing 10 as identified with—line in FIG. 1. By displacing the pin 48 in the recess 50, the push button 44 can be locked and again unlocked by the arresting projection 47 and the notch 49 in the closed position of the electric switch 36.

During assembly of the machine housing 10 from both housing shelves 12 and 13 the synthetic plastic supporting plate 29 is received by the grooves which are formed in both housing shelves 12 and 13 in correspondence with one another. During locking of both housing shelves 12 and 13 along the separating joint 11, the synthetic plastic supporting plate 29 is automatically clamped in the machine housing 10. The push button 44 with the web 43 for the actuation of the electrical switch 36 is held movably in the machine housing 10 after the assembly of the housing shelves 12 and 13.

Figure 5:
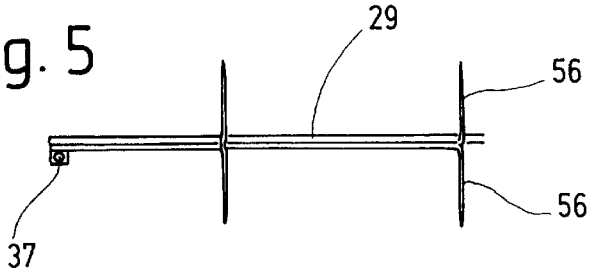
FIG. 5 is a plan view of a brush holder of the vibration grinder as seen in direction of the arrow V in FIG. 4.

The electrical hand grinder shown in a longitudinal section in FIG. 4 is a vibration grinder in which instead of the round grinding plate 20, a rectangular grinding plate 51 is provided. The grinding plate 51 is arranged centrally on the eccentric pin 19 and fixed through vibration elements 52 on the machine housing 10. Therefore during rotation of the eccentric pin 19 it performs a reciprocating grinding movement. At the lower side which faces away from the machine housing 10, the grinding plate 51 carries a burdock coating 53 for releasable mounting of a grinding paper. In this vibration grinder also in an aspiration of the grinding dust is provided, for which purpose the grinding plate 51 is hollow and has aspiration openings 23 on its lower side. A ventilator wheel 54 is mounted on the eccentric pin 19. It aspirates air from the lower side of the grinding plate 51 through the aspiration openings 23 and through the throughgoing openings 55 in the upper side of the grinding plate 51 and pumps the air into the dust passage 24. As in the eccentric grinder of FIG. 1, in the vibration grinder of FIG. 4 the ventilator wheel 18 for cooling of the motor and the eccentric pin 19 are formed again from both sheet metal stamped parts 25 and 26. Simultaneously, the ventilator wheel 54 for aspiration of dust is formed from the sheet metal stamped part 26 for the eccentric pin 19, and similarly the ventilator wheel 18 for cooling of the motor is formed from the sheet metal stamped part 25. The brush holder 28 is formed in a similar manner as in the eccentric grinder of FIG. 1, from synthetic plastic supporting plate 29. However, here it is oriented parallel to the driven shaft 15 of the electric motor 14 and clamped through a web 56 shown in FIG. 5 in the machine housing 10. The synthetic plastic supporting plate 29 carries in the same way two brush shoes 31 for receiving the carbon brushes 32, two brush pressing springs 33, a brass stamped part 34 with the contact tongue 35 and the connecting screw 37, as well as the choke 40 and the capacitor 41. The electric switch 36 with the push button 44 is formed for its actuation as the eccentric grinder of FIG. 1. Corresponding components of the electrical hand grinders of FIGS. 1 and 4 are identified with the same reference numerals.

In the electrical hand grinder formed as a vibration grinder and shown in FIG. 6, the machine housing 2 is assembled of two housing shells 12 and 13 which abut against one another along a separation joint 11. The separation joint 11 and the longitudinal axis of the machine housing 10 is located in the same plane. A grinding plate 60 is connected with the machine housing 10 by a vibration element 61. The grinding plate 60 is assembled of two plate halves 62 and 63 which abut against one another along a separating joint 64 as can be seen particularly in FIG. 8 for the housing shell 12. The separating joint 64 is located in the same plane with the separating joint 11 of the housing shells 12 and 13. Each plate halve 62 and 63 and the corresponding half of the vibration elements 61 are formed of one-piece with a housing shell 12 or 13. The vibration element 61 are formed by synthetic plastic webs which are spaced from one another and arranged parallel on a semi circular ark and extend between the grinding plate 60 and the machine housing 10. Not shown snap elements are formed on the housing shelves 12 and 13 and the plate halves 62 and 63 along their separating joints 11 and 64. They are formed in correspondence with one another and during placing of the housing shelves 12, 13 and the plate halves 62, 63 against one another they engage with each other to be arrested during pressing. After this, a dismounting of the machine housing 10 is possible only with a special tool.

Figure 7:
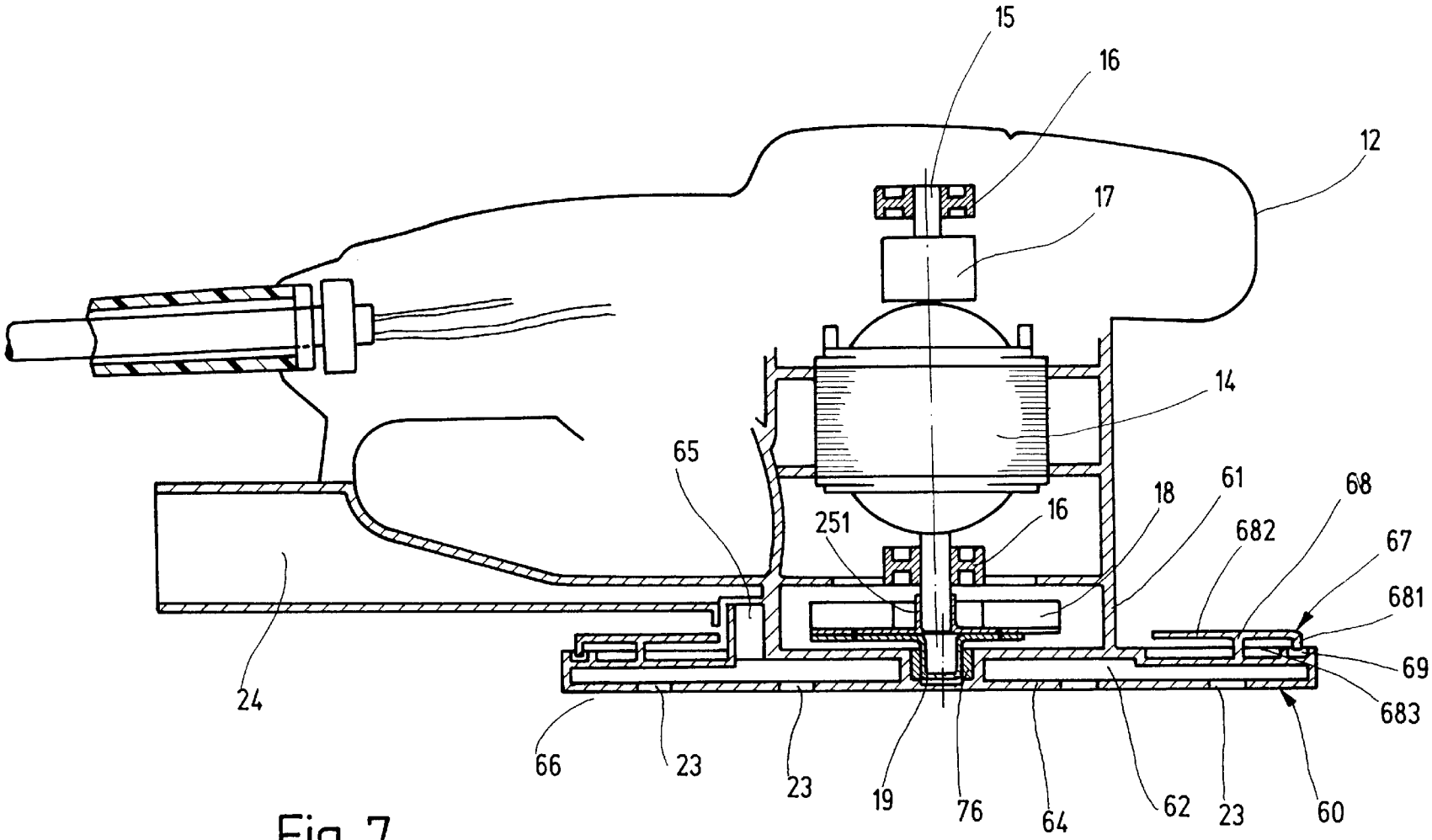
FIG. 7 is a longitudinal section of the vibration grinder in FIG. 6, partially schematically.

In the vibration grinder shown in FIG. 7 an electric motor 14 formed as a commutator motor is received in the machine housing 10 and its driven shaft 15 is supported in the bearing plates 16. A commutator 17 and a ventilator wheel 18 for cooling of the motor as well as an eccentric pin 19 for driving the grinding plate 60 are arranged non rotatably on the driven shaft 15. The illustration of the brush holder for the commutator 17 and the electrical switch for turning on and off the electric motor 14 with the manual push button for an operator of the electrical switch is here dispensed with. The ventilator wheel 18 and the eccentric pin 19 are composed of sheet metal stamped parts which are connected with one another and fitted by a sleeve 251 on the free end of the driven shaft 15. The hollow grinding plate 16 is mounted through a sliding bearing 76 on the eccentric pin 19. Since the grinding plate 60 is fixed on the machine housing through the vibration elements 61 arranged concentrically to the driven shaft 15 and no rotation can be performed, the rotating eccentric pin 90 produces a reciprocating vibration movement of the grinding plate 60.

For aspiration of grinding dusk, aspiration openings 23 are provided in the lower side of the hollow grinding plate 60, and a dust passage 24 which is formed of one-piece on the machine housing 10 is connected with an aspiration opening 65 on the upper side of the hollow grinding plate 60. The dust passage 24 in turn is connected to an external aspiration impeller.

For fixing the grinding paper, a burdock coating 66 is formed on the lower side of the grinding plate 60 of one-piece with the grinding plate by injection molding. Additionally or alternatively to the burdock coating 66, two manually actuating clamping elements 67 are provided. The clamping elements extend on the upper side which is opposite to the lower side of the grinding plate 60 and transversely to the separating joint 64. The clamping element 67 each extend along one of the transverse edges of the grinding plate 60 and formed on the plate half 62 of the grinding plate 60 of one-piece with it. The housing shells 12, 13, the vibration elements 61, the plate halves 62, 63 of the grinding plate 60 and the clamping elements 67 for mounting the grinding medium are produced in one working step with only two injection molding tools.

Figure 8:
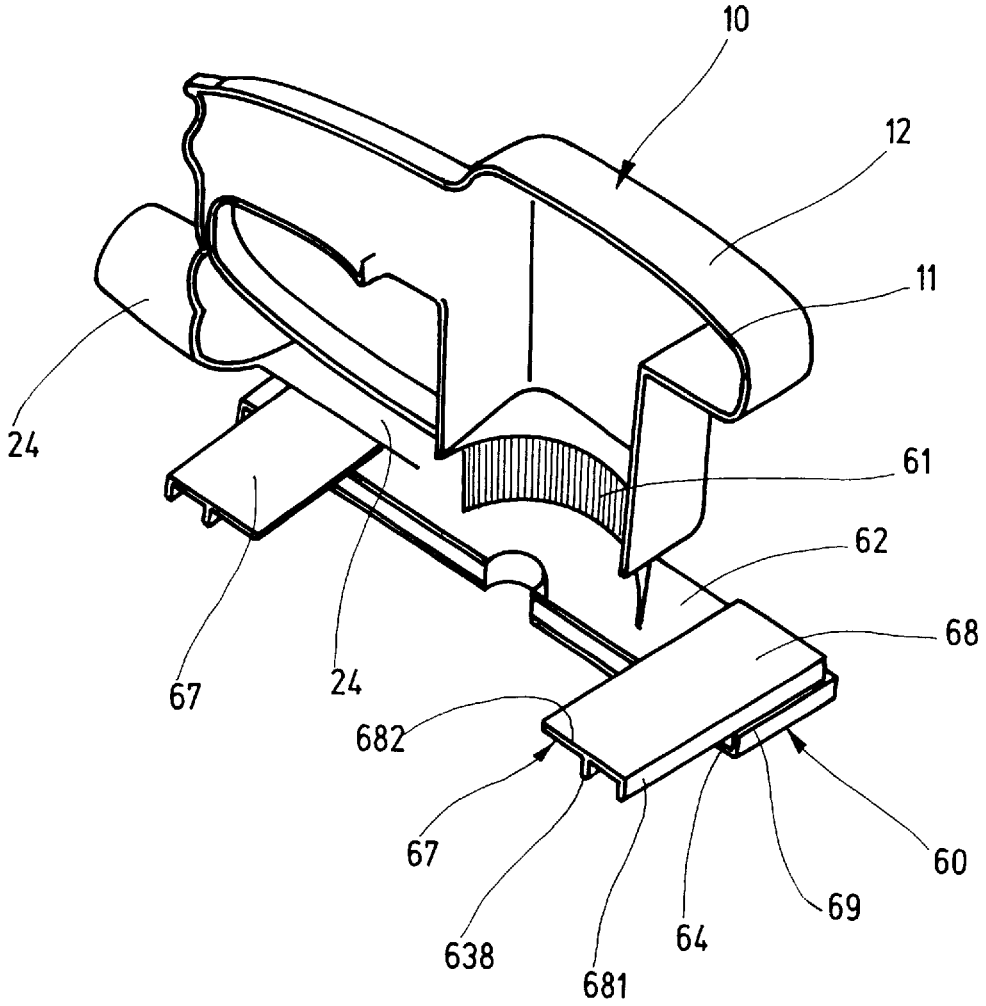
FIG. 8 is a perspective view of a housing shell of the vibration grinder of FIGS. 6 and 7.

In the embodiment example of the clamping elements 67 shown in FIGS. 6–8, the clamping elements are formed as clamping strips 68 having an L-shaped cross-section. Their shorter leg 681 is pressed with its end edge against a ground paper supporting surface 69 formed on the upper side of the grinding plate. Its longer leg 682 which extends substantially parallel to the grinding plate 60 is fixed substantially centrally on the grinding plate 60 through a transverse web 683 which extends substantially parallel to the shorter leg 681.

Figure 9:
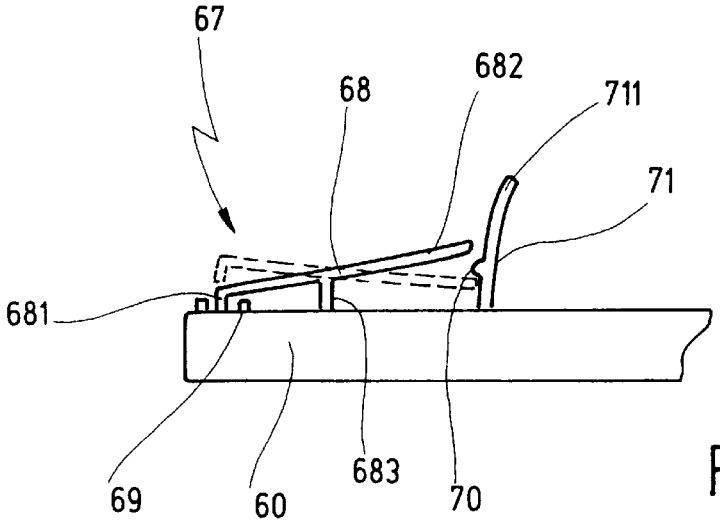
FIG. 9–11 are views showing in section a side view of a clamping element for clamping of grinding paper on the vibration grinder in FIGS. 6 and 7 in accordance with three further embodiments.
Figure 10:
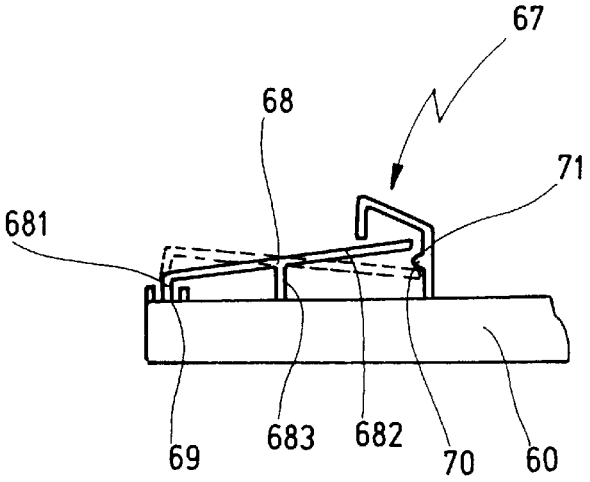
Figure 11:
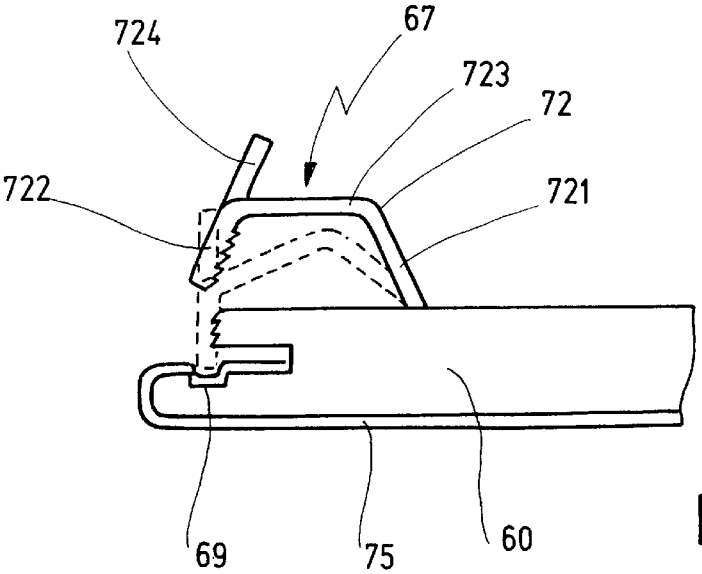

FIGS. 9–11 show further possible embodiments of the clamping elements 67. In FIG. 9 the clamping element 67 are also formed as the clamping strips 68 as the clamping elements 67 in FIGS. 6–8. In addition, near the free end of the longer end 682 of the clamping strips 68, a spring web 71 with an arresting portion 70 is arranged on the upper side of the grinding plate 60. When for insertion of the grinding paper the clamping strip 68 is lifted by pressure on the rear end of the longer leg 682, the free end of the longer leg 682 reaches the spring web 71 with the arresting portion 70. The clamping strips 68 is retained in an open position shown by—lines in FIG. 9, in which its shorter leg 681 is lifted from the grinding paper supporting surface 69. A gripping tongue 711 is formed of one-piece with the spring web 71. The spring web 71 can be springy bent by the gripping tongue 711 for lifting the clamping strip 68 from the arresting portion 70.

In the embodiment example of the clamping element 67 shown in FIG. 10, a spring web 71 with the arresting portion 70 is also arranged on the upper surface of the grinding plate 60 through the transverse web 683 of the mounted L-shaped clamping strip 68. Instead of the griping tongue, a pressing plate 712 is formed of one-piece with the spring web 71. It 15 engages the longer leg 682 of the clamping strip 68 from its free end. When the pressing plate 712 is pressed on the longer leg 682 of the clamping strip 68, the clamping strip 68 tilts around its transverse web 683. The short leg 681 is lifted from the grinding paper supporting surface 69 and the free end of the longer leg 682 is arrested under the arresting portion 70. The clamping strip 68 assumes the open position shown in FIG. 10 in—lines and the grinding paper can be exchanged. When the pressing plate 712 is again pressed on the long leg 682 of the clamping strip 68 and is displaced slightly rearwardly, the long leg 682 is disengaged from the arresting portion 70 and the clamping strip 68 presses with the end edge the short leg 681 against the grinding paper or the grinding paper supporting surface 69.

The clamping element 67 shown in the sketch in FIG. 11 is formed as a U-shaped, asymmetrical clamping bracket 72. Its longer U-leg 721 is mounted at the end side on the upper surface of the grinding plate of one-piece with it and extends from it upwardly. Its shorter U-leg 722 is pressed at one side against the grinding paper abutment surface 69 formed on the grinding plate 60. Both U-legs 721, 722 are connected with one another of one-piece by a transverse web 723. At the inner side facing the longer U-leg 721, the shorter U-leg 722 is provided with an arresting strip 73 which cooperates with arresting teeth 74 formed on the grinding plate 60. By depressing the clamping bracket 72, the arresting strip 73 engages in the arresting teeth 74, and the clamping bracket 72 can be displaced downwardly with stepped arresting until the end side of the shorter U-leg 722 presses the grinding papers 75 against the grinding paper support 69, as shown in FIG. 11 in—line. A griping part 72 projects in an extension of the shorter U-leg 722 over the transverse web 723 of the U-shaped clamping bracket 72. It serves for lifting the arresting strip 73 from the arresting teeth 74, so that the clamping bracket because of its spring action again assumes the position shown in FIG. 11 in solid lines. Thereby the grinding paper supporting surface 69 is released and the grinding paper 75 can be exchanged.

It will be understood that each of the elements described above, or two or more together, may also find a useful application in other types of constructions differing from the types described above.

While the invention has been illustrated and described as embodied in electrical hand grinder, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An electrical hand grinder, comprising a machine housing having a housing axis and composed of two housing shells which are assembled with one another along a separating joint located in a plane of said housing axis; an electric motor having a driven shaft and received in said machine housing; an eccentric pin extending outwardly of said machine housing and driven by said driven shaft of said electric motor; a grinding disk arranged on said eccentric pin and having a lower side for receiving a grinding element; a ventilator wheel for cooling said electric motor, said ventilator wheel having a first part provided with ventilator blades and carrying a one-piece sleeve and a second part carrying said eccentric pin, said ventilator wheel being arranged by said one-piece sleeve on said driven shaft of said electric motor for joint rotation with said driven schaft.

2. An electric hand grinder as defined in claim 1; and further comprising a dust aspiration passage formed on said machine housing and arranged so that said ventilator wheel is located before said dust aspiration passage.

3. An electrical hand grinder, comprising a machine housing having a housing axis and composed of two housing shells which are assembled with one another along a separating joint located in a plane of said housing axis; an electric motor having a driven shaft and received in said machine housing; an eccentric pin extending outwardly of said machine housing and driven by said driven shaft of said electric motor; a grinding disk arranged on said eccentric pin and having a lower side for receiving a grinding element; a ventilator wheel for cooling said electric motor, said ventilator wheel and said eccentric pin being formed as parts which are assembled with eccentrically oriented axes, one of said parts which forms said ventilator wheel being provided with a one-piece sleeve arranged on said driven shaft of said electric motor for joint rotation with said driven shaft; an electrical switch for turning on and turning off said electric motor and a push button for actuating said electrical switch, said push button being composed of synthetic plastic material; a springy web coated with a contact plate and formed on said push button, an arresting projection corresponding to an arresting notch in said machine housing and formed on said push button, and at least one transversely extending pin formed in correspondence with an elongated opening in said machine housing and formed on said push button; and a connecting screw extending through said contact plate for fixing a network connecting conduit and screwed in an end portion of said web.

4. An electric hand grinder as defined in claim 3, wherein said springy web is formed so that its end portion which is coated with said contact plate is located with a switching distance under a contact tongue which projects on said brass stamped part on said synthetic plastic supporting plate.

5. An electrical hand grinder, comprising a machine housing having a housing axis and composed of two housing shells which are assembled with one another along a separating joint located in a plane of said housing axis; an electric motor having a driven shaft and received in said machine housing; an eccentric pin extending outwardly of said machine housing and driven by said driven shaft of said electric motor; a grinding disk arranged on said eccentric pin and having a lower side for receiving a grinding element; a ventilator wheel for cooling said electric motor, said ventilator wheel and said eccentric pin being formed as parts which are assembled with eccentrically oriented axes, one of said parts which forms said ventilator wheel being provided with a one-piece sleeve arranged on said driven shaft of said electric motor for joint rotation with said driven shaft; and vibration elements for fixing said grinding plate on said machine housing and quick clamping means arranged on said grinding plate for the grinding element, said grinding plate being composed of two plate parts which are assembled with one another along a separating joint extending in a plane of said separating joint of said housing, each of said halves of said grinding plate and a half of said vibration elements being formed of one-piece with one of said housing shells, said housing shells and said plate halves being connected with one another along their separation joints; and snapping elements formed on said ho using shells and said plate halves of one piece with said housing shells and said plate halves and connecting said housing shells and said plate halves with one another.

6. An electric hand grinder as defined in claim 5, wherein said vibration elements are formed as synthetic plastic webs which are spaced from one another, extend parallel to one another and concentric to said driven shaft of said electric motor between said machine housing and said grinding plate.

7. An electric hand grinder as defined in claim 5, wherein said quick clamping means are formed of one-piece at least on one of said plate halves.

8. An electric hand grinder as defined in claim 7, wherein said clamping means include two manually actuatable clamping elements which extend on an upper side of said grinding plate opposite to a lower side transversely to said separating joint of said plate halves over a total width of said grinding plate near its transverse edge, said clamping elements being formed of one-piece on said plate halves.

9. An electric hand grinder as defined in claim 8, wherein each of said clamping elements is formed as a clamping strip with an L-shaped cross-section and has a shorter leg which is pressed with its end edge against a grinding element supporting surface on an upper side of said grinding plate and a longer leg which extends substantially parallel to said grinding plate and is fixed substantially centrally on said grinding plate through a transverse web extending parallel to said shorter leg.

10. An electric hand grinder as defined in claim 9; and further comprising a spring web provided with an arresting portion and formed on the upper surface of said grinding plate near a free end of said longer leg of said clamping strip so as to lock said clamping strip in its upper position in which an end edge of said shorter leg is lifted from said grinding plate.

11. An electric hand grinder as defined in claim 10, wherein said spring web has a gripping tongue for manual lifting of said arresting portion.

12. An electric hand grinder as defined in claim 11; and further comprising a pressing plate which is formed of one-piece of said spring web and engages said longer leg, said pressing plate being formed so that it is pressable on said longer leg of said clamping strip for transferring said clamping strip to its arresting position and for lifting said clamping strip from its arresting position.

13. An electric hand grinder as defined in claim 8, wherein each of said clamping elements is formed as a U-shaped clamping bracket which has one leg mounted on an upper side of said grinding plate and another leg pressable at its end against a supporting surface formed on said grinding plate for said grinding element, said grinding plate having an arresting portion, while said other leg having on its inner and outer side an arresting portion lockable with said arresting portion of said grinding plate.

14. An electric hand grinder as defined in claim 7, wherein said quick clamping means is provided with an injection molded burdock coating on a lower side of said plate halves of said grinding plate.

15. An electrical hand grinder, comprising a machine housing having a housing axis and composed of two housing shells which are assembled with one another along a separating joint located in a plane of said housing axis; an electric motor having a driven shaft and received in said machine housing; an eccentric pin extending outwardly of said machine housing and driven by said driven shaft of said electric motor; a grinding disk arranged on said eccentric pin and having a lower side for receiving a grinding element; a ventilator wheel for cooling said electric motor, said ventilator wheel and said eccentric pin being formed as parts which are assembled with eccentrically oriented axes, one of said parts which forms said ventilator wheel being provided with a one-piece sleeve arranged on said driven shaft of said electric motor for joint rotation with said driven shaft, said electric motor being formed as a commutator motor having a commutator and a brush holder with at least two axially displaceably held carbon brushes pressed at diametrical sides of a commutator by brush pressing springs; at least one capacitor and at least one choke for spark suppression; at least one connecting screw for fixing a connecting conduit on said brush holder, said brush holder being formed as a synthetic plastic supporting plate with at least two one-piece brush shoes for receiving said carbon brushes; a brass stamped part mounted on said synthetic plastic supporting plate so that said carbon brushes, said choke and said capacitor are connected with said brass stamped part and said connecting screw is screwed into said brass stamped part, said housing shells being provided with grooves which correspond to one another and arranged so that said synthetic plastic supporting part during assembly of said machine housing is received by said grooves.

* * * * *